US005309843A

United States Patent [19]

Rentzsch et al.

[11] Patent Number: 5,309,843

[45] Date of Patent: May 10, 1994

[54] WARHEAD WITH A TANDEM CHARGE

[75] Inventors: Max Rentzsch, Schnaittach; Manfred Schildknecht, Friedrichsdorf; Werner Rudenauer, Roth; Klaus Lindstadt, Schwaig; Michael Hahn, Nurnberg, all of Fed. Rep. of Germany

[73] Assignee: DIEHL GmbH & Co., Nürnberg, Fed. Rep. of Germany

[21] Appl. No.: 89,714

[22] Filed: Jul. 9, 1993

[30] Foreign Application Priority Data

Aug. 4, 1992 [DE] Fed. Rep. of Germany ..... 4225704

[51] Int. Cl.[5] ..... F42B 12/16

[52] U.S. Cl. ..... 102/476; 102/211; 102/265; 102/272

[58] Field of Search ..... 102/210, 211, 216, 265, 102/272, 273, 308, 476, 393, 489

[56] References Cited

U.S. PATENT DOCUMENTS

| | | | |
|---|---|---|---|
| 2,804,823 | 9/1957 | Jablensky | 102/476 |
| 2,809,585 | 10/1957 | Moses | 102/476 |
| 4,063,512 | 12/1977 | Davis | 102/476 |
| 4,803,928 | 2/1989 | Kramer et al. . | |
| 4,967,666 | 11/1990 | Kellner et al. | 102/476 |
| 4,982,665 | 1/1991 | Sewell et al. | 102/476 |
| 5,157,221 | 10/1992 | Ronn | 102/216 |
| 5,191,169 | 3/1993 | Hu | 102/476 |
| 5,198,615 | 3/1993 | Robbie et al. | 102/476 |
| 5,223,666 | 6/1993 | Delaney, Jr. | 102/476 |

FOREIGN PATENT DOCUMENTS

| | | | |
|---|---|---|---|
| 2629280 | 7/1985 | Fed. Rep. of Germany . | |
| 3522009 | 11/1986 | Fed. Rep. of Germany | 102/210 |
| 1002092 | 3/1952 | France | 102/476 |

*Primary Examiner*—Harold J. Tudor
*Attorney, Agent, or Firm*—Scully, Scott, Murphy & Presser

[57] ABSTRACT

A warhead which may be integrated, for example, in a bazooka, is capable of shooting through a wall protecting an enemy. For that purpose, a tandem charge includes a hollow charge which produces in the wall a firing passage for a follow-up charge. The follow-up charge is in the form of a fragmentation projectile which produces fragments behind the wall.

7 Claims, 2 Drawing Sheets

WARHEAD WITH A TANDEM CHARGE

BACKGROUND OF THE INVENTION

1. Field of the Invention

The present invention relates to a warhead with a tandem charge, including a fuze for sensing a target. A tandem charge includes a hollow charge which is fixed with respect to a housing, and with a smaller-caliber second-fired or follow-up charge being axially displaceable within a guide tube for the subsequent flight of the second-fired charge. Included are safety devices for the first and second-fired charges, providing for a firing delay for the second-fired charge.

2. Discussion of the Prior Art

A warhead with a tandem charge as set forth hereinabove is generally known from the disclosure of U.S. Pat. No. 4,803,928. In a housing there are arranged a target detector for either impact or proximity, an explosive charge operating on the principle of a hollow charge, a guide housing having an axially guided second-fired charge arranged therein, a propellent charge for the second-fired charge and a detonator for triggering of the hollow charge and of the second-fired charge. The guide housing for the second-fired charge together with the propellent charge thereof is pressure-resistant because of the high pressure exerted thereon by the propellent charge, and consequently possesses a comparatively large weight. This essentially signifies that the warhead is adapted for the destruction of aircraft runways by the explosive charge which produces a bore in the concrete slab of the runway, into which there penetrates the second-fired charge and then detonates therein.

Moreover, German Patent 26 29 280 discloses a warhead designed for deployment against aircraft which are disposed in shelters. That particular warhead incorporates a structure which, in principle, is similar to that disclosed in the above-mentioned U.S. Pat. No. 4,803,928. In that arrangement, however, the second-fired charge which is propelled by a propellent charge is in the form of a fragmentation projectile in order to increase the hitting probability thereof.

The above-mentioned known warheads are not suitable for use in combat areas and against shelters or dugouts which are protected behind barricades or barriers, since in fact the barriers which are constituted from heterogeneous materials are penetrated but, due to the high kinetic energy of the warhead, the latter is either not triggered or detonated too late.

It is readily obvious, that due to new and more stringent target criteria, represented by a barrier or barricade, it is necessary to correspondingly change the sensor device of the fuze. The foregoing then results in the unsatisfactory only partially successful condition that the barrier is admittedly penetrated by the hollow charge; however, the second-fired charge does not produce an effect by virtue of its delayed or post-acceleration.

SUMMARY OF THE INVENTION

Accordingly, it is a general object of the present invention to provide a projectile for effectively combatting an enemy located under cover; for example, such as a sniper when engaged in house-to-house combat, in respect to which the term cover signifies the walls of houses and buildings, barricades, and protective walls and barriers.

The invention attains its object in that the second-fired or follow-up charge of the tandem charge of the warhead is in the form of a fragmentation projectile adapted to be accelerated in the direction of flight in the absence of a separate propellent charge, solely due to its mass inertia upon impact of the warhead and notwithstanding the detonation of the hollow charge.

At a caliber of 90 mm for the warhead, the hollow charge blows a passage having a diameter of about 50 to 60 mm through a target. The fragmentation projectile passes through that passage into the target and detonates at about 0.5 to 2.5 meters behind the target with an extensive fragmentation effect in the adjoining affected area. The essential consideration is that, by virtue of its mass inertia, upon impact of the warhead against the target, the follow-up charge continues its forward movement almost unretarded by the detonation of the hollow charge. Consequently, there is no need to provide for a separate acceleration charge for the follow-up or second-fired charge. This feature, pursuant to the invention, renders it possible in a simple manner to place the follow-up charge in its intended area of action; in effect, without requiring the expenditure of additional mechanical or pyrotechnic equipment.

In accordance with a specific aspect, the warhead incorporates a piezo-fuze and contact sensor so as to be universally employed both against hard targets for example, masonry, and also against soft targets, such as sand bags or earthworks.

Delayed detonation of the follow-up charge is achieved in a simply manner through the intermediary of a time-delay detonator.

An inexpensive low-weight warhead is provide through the use of aluminum, whereby the warhead can be launched by either mechanized launching equipment and also manually from the shoulder by means of a bazooka.

An inexpensive insert or support for the hollow charge is formed of a flat or shallow cone of aluminum.

BRIEF DESCRIPTION OF THE DRAWINGS

Reference may now be had to preferred embodiments of the invention, as illustrated in the drawings; in which.

DETAILED DESCRIPTION

Figure 1:
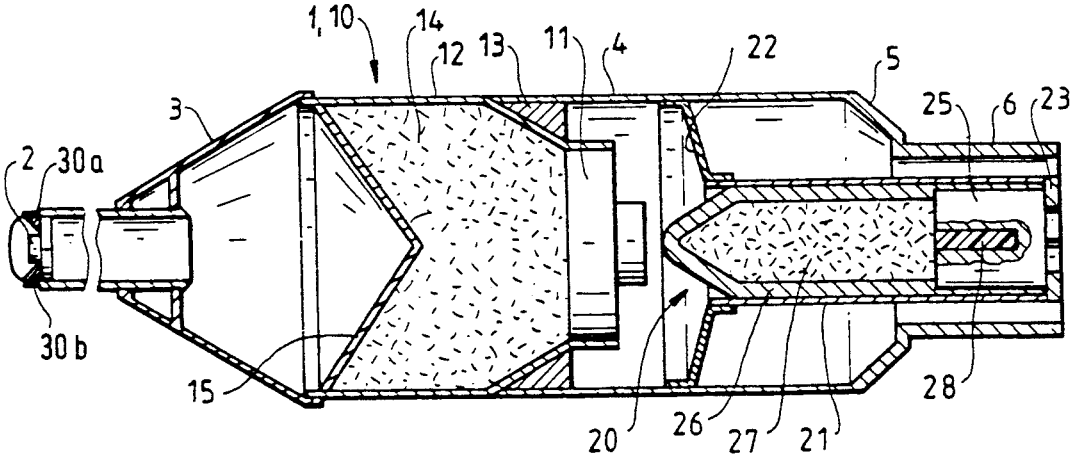
FIG. 1 illustrates a longitudinal sectional view of a warhead.

A warhead 1 comprises an axially extendable fuze 2, a ballistic cover 3, a cylindrical casing 4 having a cone 5 at its tail end and a receiving case 6, a hollow charge 10 with a safety or safe-and-arm device 11, a second-fired or follow-up charge 20 with a guide tube 21 and support collar 22, and with an apertured plate 23 and a safety device 25 being integrated into the follow-up charge 20 at the tail end including a pyrotechnic time-delay detonator 28.

Figure 2:
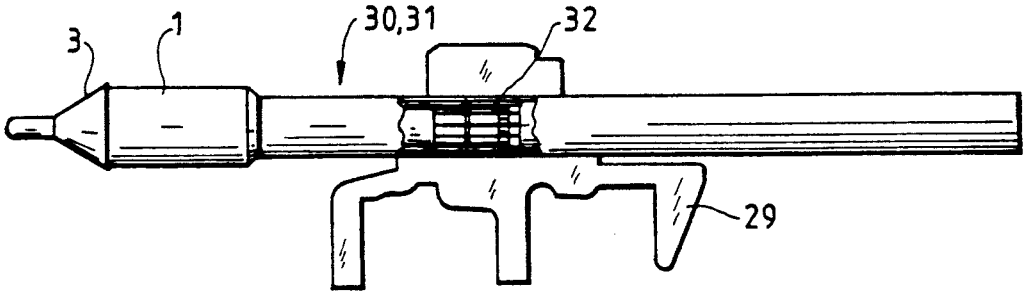
FIG. 2 illustrates a bazooka equipped with the warhead of FIG. 1.
Figure 5:
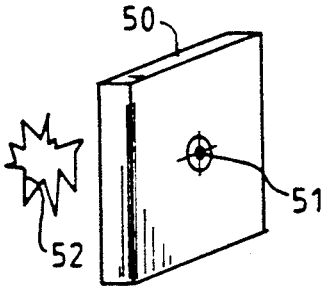
FIGS. 3, 4 and 5 illustrate successive physical phases in the striking of a target by the warhead.
Figure 4:
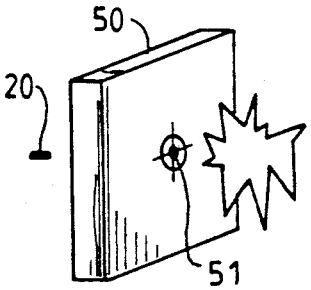

The fuze 2 is equipped with two sensors 30*a* and 30*b*, in a manner diagrametically illustrated in the drawings. One of the sensors is a piezo-sensor for hard targets; for example, such as masonry, and the other sensor is designed for non-hard or soft targets; for example, such as for sandbags, earth, wood or the like. In its transport condition, each sensor 30*a*, 30*b* is arranged in a retracted condition in the ballistic cover 3, as shown in FIG. 2. In a combat situation, the sensor is fixed in the extended operative position, as illustrated in FIG. 1. Furthermore, it is also possible to provide the warhead with a proximity fuze.

The hollow charge 10 incorporates a separate housing 12 which is fixedly connected to the casing 4 by means of a coupling ring 13. The safety device 11, an explosive charge 14 and a shallow conical insert or support 15 of aluminum are fixed within the housing 12 of the hollow charge.

The second-fired or follow-up charge 20 comprises a fragmentation casing 26 with an explosive 27 and the safety or safe-and-arm device 25.

As shown in FIG. 2, the warhead 1 which is illustrated in FIG. 1 is adapted to be designed as a bazooka grenade 30 which can be fired from a suitable launching support 29. The bazooka grenade 30 is equipped with a rocket drive assembly 31 and extendable guide vanes 32.

Figure 3:
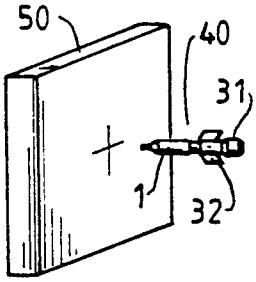

A further embodiment of a grenade 40, as shown in FIG. 3, comprises the warhead 1, including vanes 32 and rocket drive assembly 31.

Upon firing of the warhead 1 in conjunction with the grenade 40, the grenade is accelerated to a launching velocity of about 270 m/s. After a flying distance of five meters, the safety device 11 is armed so that the hollow charge 10 with the follow-up charge 20 is now ready for firing.

When the warhead 1 strikes a target 50, the fuze 2 transmits a firing pulse to the safety device 11. The latter device 11 triggers the hollow charge 10 by means of the explosive 14, resulting in deforming the insert 15 into a pointed member or spike (not shown). When the hollow charge 10 possesses a caliber of 90 mm, the pointed member or spike passes through the target 50 with a speed for the spike point of about 6000 m/sec.; and forms in the target a passage 51 which is about 50 to 60 mm in diameter. The follow-up charge 20 passes through the passage 51 into the target and detonates at location 52 at a distance of about 0.5 to 2.5 meters behind the target, with the generation of an intensive fragmentation effect in the surrounding area. For purposes of initiating the actuation of the follow-up charge 20, concurrently with the firing of the hollow charge 10, there is triggered the delay detonator 28 of the follow-up charge 20. The time-delay detonator 28 fires the follow-up charge 20 subsequently at about a 12 ms delay.

Upon the warhead 1 striking the target 50 at either a right angle or at an inclined angle, there are achieved the following penetrating performances or distances with a fragmentation action by the follow-up charge 20:

Concrete walls, penetrating distance: about 40 cm;
Brick walls, penetrating distance: about 50 cm;
Wood, penetrating distance: about 60 to 80 cm;
Sandbags, penetrating distance: about 50 to 70 cm.

In the case of the presence of wall or window openings, the effect in the target due to the detonation of the hollow charge is encountered in the room behind the wall.

The warhead 1 can be utilized under universal conditions, such as by being employed in conjunction with artillery ammunition or rockets; for example, in a guided anti-tank rocket, such as a MILAN.

What is claimed is:

1. A warhead comprising a housing; a tandem charge in said housing; a fuze for sensing a target; said tandem charge including a hollow charge which is stationarily fixed in said housing; a follow-up charge of caliber smaller than that of the hollow charge being axially displaceable in a guide tube for the subsequent flight of the follow-up charge, said guide tube and said follow-up charge being located rearwardly of said hollow charge; and safety means for said charges providing for a firing delay for the follow-up charge; said follow-up charge being in the form of a fragmentation projectile accelerateable in the direction of flight in the absence of a separate propellent charge responsive to the mass inertia thereof upon impact of the warhead and notwithstanding a detonation of the hollow charge, and means for concurrently activating a pyrotechnic delay detonator, upon firing of said hollow charge, for the time-delayed firing of the follow-up charge.

2. A warhead as claimed in claim 1, wherein said fuze comprises a piezo-fuze for hard targets and a contact sensor for soft targets.

3. A warhead as claimed in claim 1, wherein portions of the housing of the warhead for the hollow charge and for the follow-up charge are constituted of a thin-walled and lightweight material, and the strength of said housing portions is designed to enable the storage, transportation and stability in flight of the warhead.

4. A warhead as claimed in claim 3 wherein said housing portions consist of aluminum.

5. A warhead as claimed in claim 1, wherein an inset for forming the hollow charge comprises a shallow metallic cone.

6. A warhead as claimed in claim 5, wherein said insert consists of aluminum.

7. A warhead as claimed in claim 1, wherein said fuze comprises a proximity fuze.

* * * * *